US010531205B1

(12) United States Patent
Oesch

(10) Patent No.: US 10,531,205 B1
(45) Date of Patent: Jan. 7, 2020

(54) SYSTEM AND METHOD FOR OPTIMIZING BATTERY USAGE FOR A BINAURAL HEARING SYSTEM

(71) Applicant: SONOVA AG, Staefa (CH)

(72) Inventor: Yves Oesch, Neuchatel (CH)

(73) Assignee: Sonova AG, Staefa (CH)

( * ) Notice: Subject to any disclaimer, the term of this patent is extended or adjusted under 35 U.S.C. 154(b) by 0 days.

(21) Appl. No.: 16/036,782

(22) Filed: Jul. 16, 2018

(51) Int. Cl.
*H04R 25/00* (2006.01)

(52) U.S. Cl.
CPC ..... *H04R 25/552* (2013.01); *H04R 25/30* (2013.01); *H04R 25/558* (2013.01)

(58) Field of Classification Search
USPC ..... 381/315, 323
See application file for complete search history.

(56) References Cited

U.S. PATENT DOCUMENTS 7,254,246 B2 * 8/2007 Jakob ..... H04R 25/552 381/312
7,778,432 B2 * 8/2010 Larsen ..... H04R 25/554 381/314
9,866,973 B2 1/2018 Park et al.
2013/0316642 A1 11/2013 Newham
2016/0080877 A1 * 3/2016 Holm ..... H04R 25/552 381/23.1
2016/0157026 A1 * 6/2016 Guindi ..... H04R 25/305 381/60
2016/0183009 A1 6/2016 Kim et al.
2016/0219358 A1 * 7/2016 Shaffer ..... H04R 1/1041
2017/0238103 A1 * 8/2017 Gehring ..... H04R 25/552 381/23.1

* cited by examiner

*Primary Examiner* — Quoc D Tran
(74) *Attorney, Agent, or Firm* — ALG Intellectual Property, LLC

(57) ABSTRACT

A fitting system is configured to determine a first power consumption metric for a first hearing device included in a binaural hearing system configured to wirelessly communicate with an external device during a communication session, determine a second power consumption metric for a second hearing device included in the binaural hearing system, determine that the first power consumption metric is lower than the second power consumption metric, and assign, based on the determination that the first power consumption metric is lower than the second power consumption metric, a first operating role to the first hearing device. The first operating role specifies that the first hearing device is to be wirelessly connected with the external device during the communication session.

19 Claims, 7 Drawing Sheets

SYSTEM AND METHOD FOR OPTIMIZING BATTERY USAGE FOR A BINAURAL HEARING SYSTEM

BACKGROUND INFORMATION

A binaural hearing system configuration includes two hearing devices (e.g., hearing aids), one for each ear. Binaural hearing systems often provide users with improved sound quality, perception, and localization compared to monaural hearing device configurations.

It is often desirable for binaural hearing system to wirelessly connect to an external device, such as a mobile computing device or other audio source, to deliver audio content output by the external device to the ears of a user. For example, it is often desirable for binaural hearing systems to wirelessly connect to a user's smartphone via a Bluetooth link so that the binaural hearing system can deliver audio content (e.g., phone calls, music, etc.) output by the smartphone to both ears of the user.

Unfortunately, some conventional wireless protocols prevent an external device from concurrently being wirelessly connected with more than one hearing device at a time. As such, in some binaural hearing system configurations that include first and second hearing devices, the first hearing device may wirelessly connect to an external device, receive audio data output by the external device, and then relay the received data to the second hearing device by way of a binaural communication link between the two hearing devices. Audio data or audio packets are understood as data packets representing audio content. In other binaural hearing system configurations, the second hearing device acts as an "eavesdropper" by listening to the traffic between the first hearing device and the external device without the external device being aware of the second hearing device. In either of these manners, the second hearing device may receive and process the data output by the external device even though the second hearing device is not itself wirelessly connected with the external device. It should be noted that, establishing a Bluetooth communication session requires a pairing step, when two devices are connected for the first time. A pairing information persists in both devices. If at a later point in time the devices establish a further communication session, the pairing step is not necessary, as the information is already available in each of the devices.

Although this configuration may allow both hearing devices to receive audio content output by the external device, the hearing device that is wirelessly connected with the external device consumes a relatively significant amount of current (and hence, power) to maintain a wireless communication link with the external device. To illustrate, in the example above the first hearing device may consume around 100 microamps (uA) in a standby mode (i.e., while the first hearing device waits for the external device to begin outputting data that is to be processed by the first and second hearing devices) to maintain the wireless communication link. Over the course of sixteen hours (a typical amount of time that hearing devices are used by a user each day), this current consumption may be around ten percent of the first hearing device's battery capacity. During a communication session (i.e., while the first hearing device is actively receiving and processing audio content output by the external device), the current consumption by the first hearing device may be significantly higher.

BRIEF DESCRIPTION OF THE DRAWINGS

The accompanying drawings illustrate various embodiments and are a part of the specification. The illustrated embodiments are merely examples and do not limit the scope of the disclosure. Throughout the drawings, identical or similar reference numbers designate identical or similar elements.

DETAILED DESCRIPTION

Figure 1:
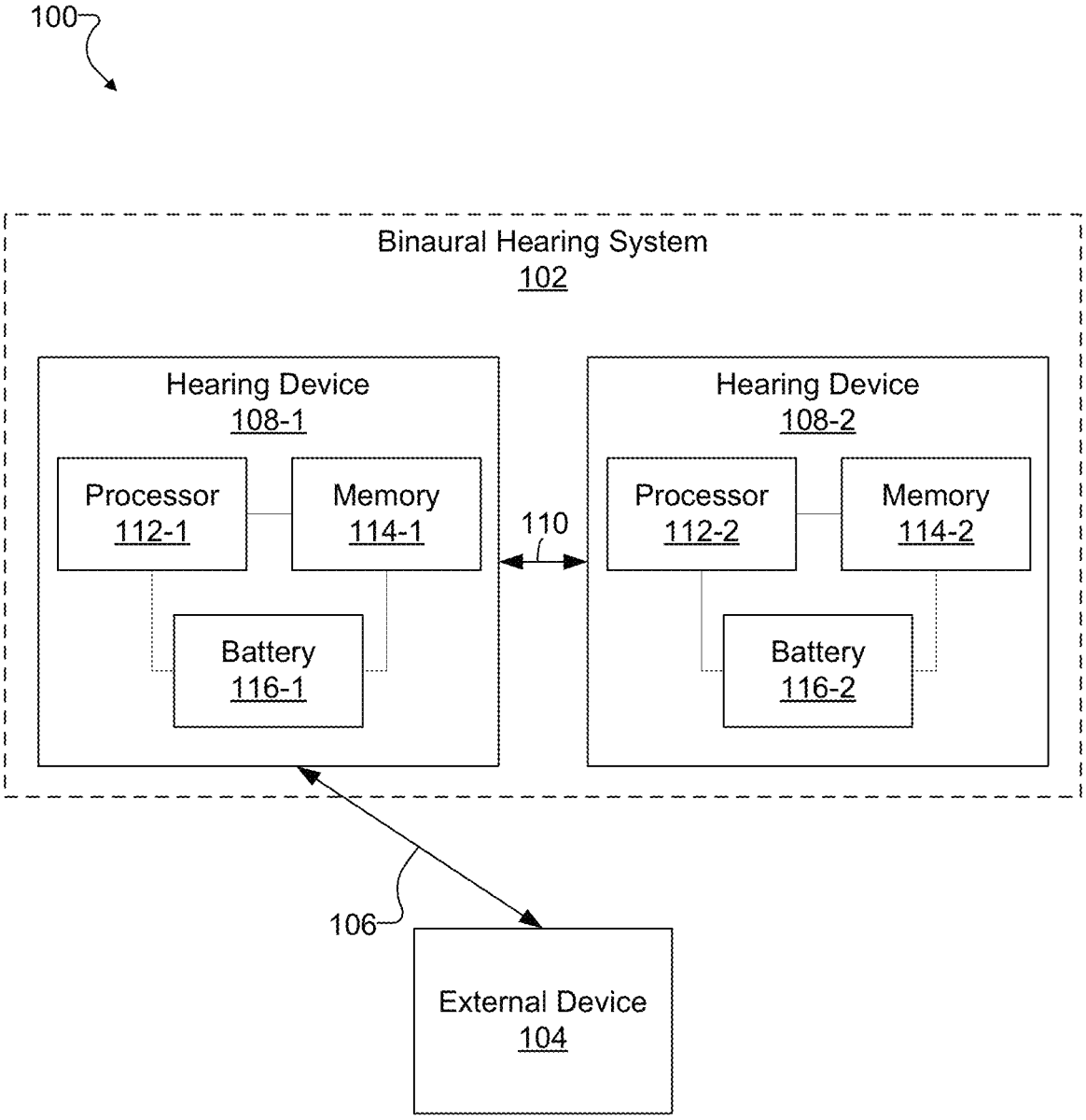
FIGS. 1-2 illustrate exemplary configurations in which a binaural hearing system is configured to communicate with an external device according to principles described herein.

Systems and methods for optimizing battery usage for binaural hearing systems are described herein. In particular, the systems and methods described herein may optimize battery usage for first and second hearing devices included in a binaural hearing system configured to wirelessly communicate with an external device during a communication session.

To this end, the binaural hearing system may be communicatively coupled to a fitting system. The fitting system may optimize battery usage of the first and second hearing devices by first determining a first power consumption metric for the first hearing device and a second power consumption metric for the second hearing device.

As used herein, a "power consumption metric" for a hearing device included in a binaural hearing system may include any indicator of power consumption by the hearing device. For example, a power consumption metric for a hearing device may indicate an amount of power (e.g., an absolute amount of power or an amount of power in terms of a percentage of the hearing device's total battery capacity) or an average current that the hearing device is expected to consume during a given time period while performing various operations (e.g., detecting and amplifying audio content, communicating with another hearing device by way of a binaural communication link, etc.).

A computing device comprised in the fitting system may compare the first and second power consumption metrics for the first and second hearing devices, respectively, and assign a first operating role to the hearing device that has the lowest power consumption metric and a second operating role to the hearing device that has the highest power consumption metric. For example, if the first power consumption metric for the first hearing device is less than the second power consumption metric for the second first hearing device, the fitting system assigns a first operating role to the first hearing device and a second operating role to the second hearing device. The first operating role assigned to the first hearing device specifies that the first hearing device is to be wirelessly connected with the external device during the communication session. The second operating role assigned to the second hearing device specifies that the second hearing device is to remain wirelessly unconnected with the external device during the communication session. In this configuration, the second hearing device may receive the audio content from the first hearing device by way of the binaural communication link or by operating in an eavesdropping mode in which the second hearing device listens to traffic between the external device and the first hearing device. The communication session starts, when the first hearing device connects to the external device and the communication session ends upon disconnection of the first device from the external device. "Connecting" is understood in the sense, that two devices, which connect to each other at least initially exchange information bidirectionally. In this sense the second device operating in eavesdropping mode is unconnected to the external device.

The systems and methods described herein may allow the hearing device that has the lowest power consumption demands (and therefore the most available power to establish and maintain a wireless communication link) to be selected as the hearing device that wirelessly connects to the external device. Advantageously, this may also extend a battery life of the other hearing device that has relatively higher power consumption demands. This may improve battery life of the binaural hearing system as a whole, which may allow a user of the binaural hearing system to go longer between battery charging or changing sessions.

Assigning an operating role to the first hearing device or the second hearing device by the computing device should be understood in the sense, that the computing device acts automatically or upon request and provides a default configuration for operating roles of the hearing devices of the hearing system which is actually fitted. In some embodiments, the fitting system comprises a user interface, which allows the user to override the default configuration for the operating roles provided by the computing device.

The fitting system is adapted to configure the first hearing device or the second hearing device according to the assigned first or second operating role. The fitting system configures the two hearing devices as a hearing system operating in the desired way with regard to connectivity with an external device. The fitting system can be a computer as it is typically used in a clinic of an audiologist, it can however also be a portable computer or a smart phone.

FIG. 1 illustrates an exemplary configuration 100 in which a binaural hearing system 102 is configured to communicate with an external device 104 by way of a selectively established wireless communication link 106 during a communication session. As shown, binaural hearing system 102 includes a first hearing device 108-1 and a second hearing device 108-2 (collectively "hearing devices 108"). Hearing devices 108 may communicate one with another by way of a binaural communication link 110. Each element shown in configuration 100 will now be described in detail.

External device 104 may include any computing device that outputs audio content (e.g., speech, music, or other sounds) and that is capable of being wirelessly connected with one of hearing devices 108. For example, external device 104 may be a mobile device (e.g., a mobile phone such as a smartphone, a tablet computer, a laptop computer, a mobile gaming device), a desktop computer, a television, a speaker, etc.

Hearing devices 108 may each be implemented by any type of hearing device configured to provide or enhance hearing to a user of binaural hearing system 102 as may serve a particular implementation. For example, hearing devices 108 may each be implemented by a hearing aid configured to apply acoustic stimulation (e.g., amplified audio content) to a user, a sound processor included in a cochlear implant system configured to apply electrical stimulation representative of audio content to a user, a sound processor included in an electro-acoustic stimulation system configured to apply electro-acoustic stimulation to a user, or any other suitable hearing prosthesis. In some examples, hearing device 108-1 is of a different type than hearing device 108-2. For example, hearing device 108-1 may be a hearing aid and hearing device 108-2 may be a sound processor included in a cochlear implant system.

As shown, each hearing device 108 includes a processor, memory, and a battery (among other components). For example, hearing device 108-1 includes processor 112-1, memory 114-1, and battery 116-1. Likewise, hearing device 108-2 includes processor 112-2, memory 114-2, and battery 116-2.

Processors 112 are configured to perform various processing functions, such as receiving and processing audio content output by external device 104. Processors 112 may each be implemented by any suitable combination of hardware and software.

Memory 114 may be implemented by any suitable type of storage medium and may maintain (e.g., store) data utilized by processors 112. For example, memory 114 may store data representative of an operation program that specifies how each processor 112 processes and delivers audio content to a user. To illustrate, if hearing device 108-1 is a hearing aid, memory 114-1 may maintain data representative of an operation program that specifies an audio amplification scheme (e.g., amplification levels, etc.) used by processor 112-1 to deliver acoustic content output by external device 104 to the user. As another example, if hearing device 108-1 is a sound processor included in a cochlear implant system, memory 114-1 may maintain data representative of an operation program that specifies a stimulation scheme used by hearing device 108-1 to direct a cochlear implant to apply electrical stimulation representative of acoustic content output by external device 104 to the user. Memory 114 may additionally or alternatively maintain data representative of a first operating role first operating role or a second operating role, as will be described below.

Battery 116-1 is configured to provide operating power for processor 112-1, memory 114-1, and/or other components included in hearing device 108-1. Likewise, battery 116-2 is configured to provide operating power for processor 112-2, memory 114-2, and/or other components included in hearing device 108-2. In some examples, batteries 116 are rechargeable. Alternatively, batteries 116 are non-rechargeable. Batteries 116 may have any suitable capacity, discharge profile, and/or other characteristic as may serve a particular implementation.

Hearing devices 108 may communicate with each other (e.g., by transmitting data) by way of a binaural communication link 110 that interconnects hearing devices 108. Binaural communication link 110 may include any suitable wireless or wired communication link as may serve a particular implementation.

To facilitate communication between binaural hearing system 102 and external device 104, one of hearing devices 108 may be wirelessly connected with external device 104. The wireless pairing establishes wireless communication link 106. Wireless communication link 106 may include a Bluetooth link (e.g., a Bluetooth classic link or a Bluetooth low energy link), a near field communication ("NFC") link, or any other suitable point-to-point link. To this end, hearing devices 108 and external device 104 may each include a wireless interface configured to operate in accordance with any suitable wireless communication protocol.

In the example of FIG. 1, hearing device 108-1 is wirelessly connected with external device 104. Hence, wireless communication link 106 is shown to be between hearing device 108-1 and external device 104. Hearing device 108-1 and/or external device 104 may establish and maintain wireless communication link 106 using any suitable wireless pairing technique.

Once wireless communication link 106 is established, hearing device 108-1 and external device 104 may communicate by way of wireless communication link 106. For example, external device 104 may transmit data to hearing device 108-1 by way of wireless communication link 106. This data may include audio packets representative audio content output by external device 104 and/or any data (e.g., metadata) associated with of any suitable data associated with audio content output by external device 104. External device 104 may additionally or alternatively transmit other types of data, such as data representative of an identity of external device 104, to hearing device 108-1 by way of wireless communication link 106. Hearing device 108-1 may also transmit data to external device 104 by way of wireless communication link 106. For example, hearing device 108-1 may transmit audio packets representative of the user's voice, control data (e.g., acknowledgement data for maintaining wireless communication link 106), and/or any other suitable data to external device 104.

As used herein, a "communication session" refers to a period of time during which one of hearing devices 108 (hearing device 108-1 in the example of FIG. 1) is wirelessly connected with external device 104, thereby facilitating communication between binaural hearing system 102 and external device 104. A communication session may begin in response to wireless communication link 106 being established (e.g., in response to hearing device 108-1 being wirelessly connected with external device 104). The communication session may end when wireless communication link 106 is terminated. Termination of wireless communication link 106 may be caused by either or both of external device 104 and hearing device 108-1 powering down, by a shutting down of a communication interface (e.g., a Bluetooth communication interface) at either external device 104 or hearing device 108-1, in response to a user and/or system generated command for the wireless communication link 106 to be terminated, etc. The duration of the communication session may be any suitable length.

During the communication session, hearing device 108-1 may be in a standby mode when external device 104 is not outputting data (e.g., audio content) that is to be processed by hearing device 108-1. Hearing device 108-1 may alternatively be in an active mode while external device 104 is outputting data that is to be processed by hearing device 108-1. For example, in cases where external device 104 is a smartphone, hearing device 108-1 may enter a standby mode after completion of an audio call. Another incoming call to the smartphone may cause hearing device 108-1 to switch to the active mode and receive audio content associated with the call by way of wireless communication link 106.

In some examples, while hearing device 108-1 is wirelessly connected with external device 104, hearing device 108-1 may relay (i.e., transmit) audio content received from external device 104 to hearing device 108-2 by way of binaural communication link 110. For example, audio packets received by hearing device 108-1 from external device 104 by way of wireless communication link 106 may be relayed by hearing device 108-1 to hearing device 108-2. In this manner, hearing device 108-2 may receive and process audio content from external device 104 without sending information to external device 104.

Alternatively, hearing device 108-2 may receive the audio packets transmitted from external device 104 by operating in an eavesdropping mode. While in the eavesdropping mode, hearing device 108-2 may receive information (e.g., frequency hopping sequence information, clock frequency and phase offset information, encryption key information, address information, etc.) from hearing device 108-1 by way of binaural communication link 110 that allows hearing device 108-2 to passively listen to (i.e., have access to) traffic (i.e., audio packets) that is transmitted between hearing device 108-1 and external device 104. For example, hearing device 108-2 may use the information to establish a one-way communication channel with external device 104 and/or otherwise detect audio packets that are wirelessly transmitted from external device 104 to hearing device 108-1. Regardless of how hearing device 108-2 listens to the traffic, external device 104 is not aware that hearing device 108-2 is receiving the audio packets. In other words, hearing device 108-2 receives the audio content without the necessity to send information to the external device 104. Because hearing device 108-1 enables receipt of the audio packets by hearing device 108-2, hearing device 108-1 may be referred to as an eavesdropper enabler.

Figure 2:
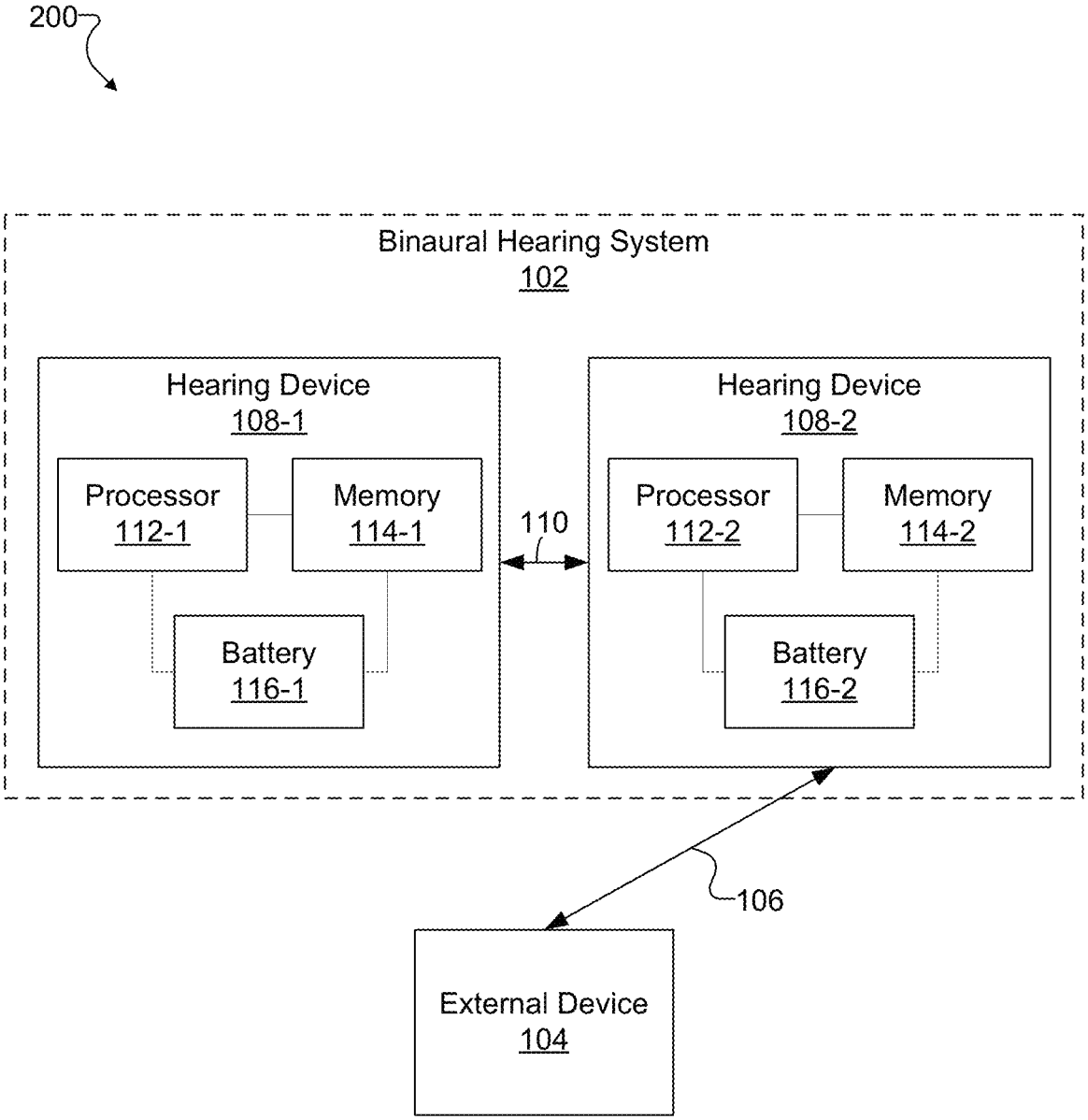

FIG. 2 illustrates an alternative configuration 200 in which hearing device 108-2 (and not hearing device 108-1) is wirelessly connected with external device 104. Hence, wireless communication link 106 is shown in FIG. 2 to be between hearing device 108-2 and external device 104. In configuration 200, hearing device 108-2 may receive audio content from external device 104 by way of wireless communication link 106 and enable hearing device 108-1 to receive the audio content without being wirelessly connected with external device 104 in any of the ways described herein.

The systems and methods described herein may select which hearing device (i.e., hearing device 108-1 or hearing device 108-2) is to be wirelessly connected with external device 104 during a communication session. The selection may be based on the respective power consumption demands of hearing device 108-1 and hearing device 108-2. In this manner, battery usage of hearing devices 108 is optimized. This selection may be performed during a fitting session in which binaural hearing system 102 is communicatively coupled with a fitting system.

Figure 3:
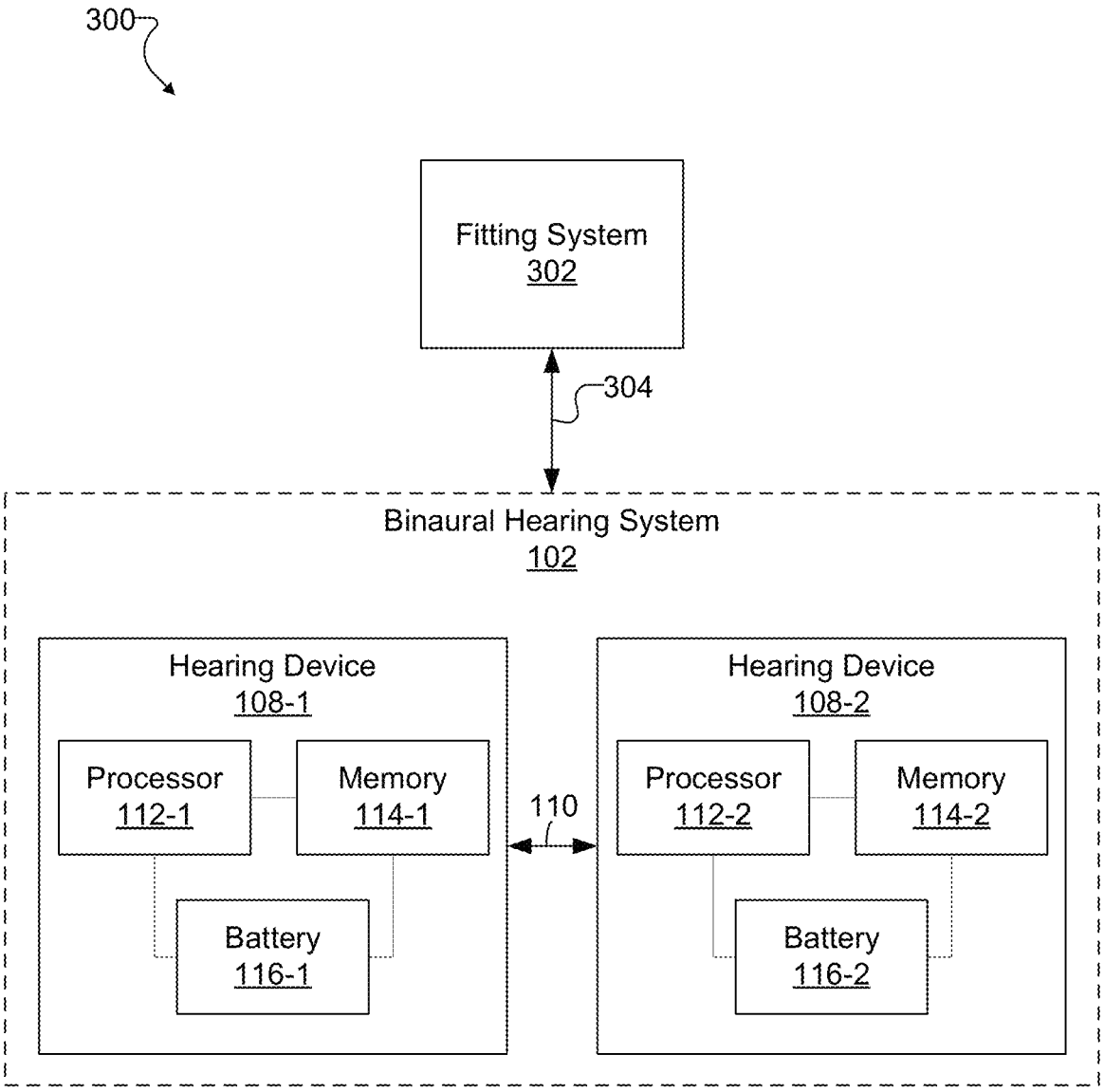
FIG. 3 illustrates an exemplary configuration in which a fitting system is communicatively coupled with a binaural hearing system according to principles described herein.

FIG. 3 illustrates an exemplary configuration 300 in which a fitting system 302 is communicatively coupled with binaural hearing system 102 by way of a fitting communication link 304 during a fitting session. Fitting communication link 304 may include any suitable wired or wireless communication link between fitting system 302 and either or both of hearing devices 108.

FIG. 3 shows that binaural hearing system 102 is not communicatively coupled with external device 104 during the fitting session. However, in some alternative examples, binaural hearing system 102 may be communicatively coupled with external device 104 during the fitting session.

Figure 4:
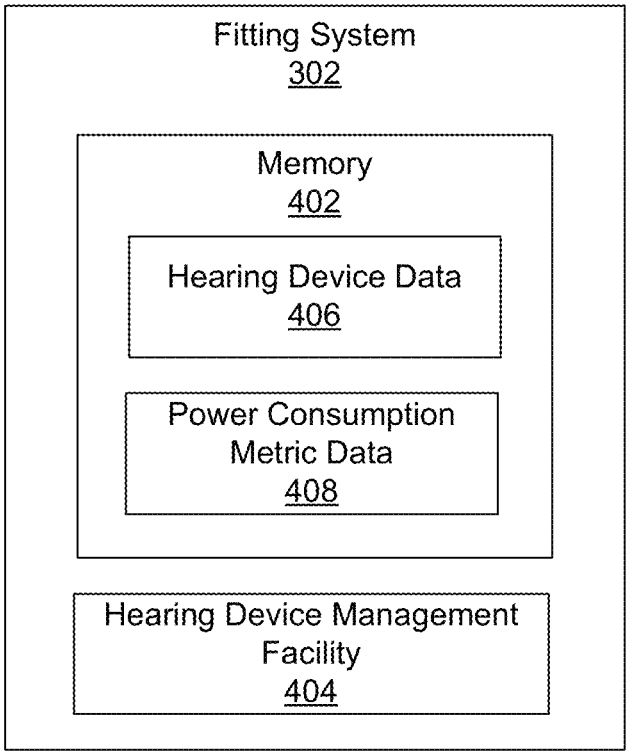
FIG. 4 illustrates exemplary components of a fitting system according to principles described herein.

FIG. 4 illustrates exemplary components of fitting system 302. As shown, fitting system 302 includes a memory 402 and a hearing device management facility 404 ("management facility 404") selectively and communicatively coupled to one another. Fitting system 302 may include additional or alternative components as may serve a particular implementation. Fitting system 302 (i.e., any of the components included in fitting system 302) may be implemented by any suitable combination of hardware and software. For example, fitting system 302 may be implemented by a computing device (e.g., a physical computing device such as a desktop computer, a mobile computing device, etc.) that has a physical processor and memory.

Memory 402 may include any type of transitory or non-transitory memory and/or storage medium for maintaining data used and/or generated by management facility 404. As shown, memory 402 maintains hearing device data 406 and power consumption metric data 408. Memory 402 may maintain additional or alternative data as may serve a particular implementation.

Hearing device data 406 may include data representative of one or more characteristics of hearing devices 108. For example, hearing device data 406 may include data representative of a unique identifier (e.g., a serial number) of each hearing device 108, an operation program loaded on to and used by each hearing device 108, a side designation (e.g., left ear or right ear) of each hearing device 108, a make and model of each hearing device 108, a battery characteristic (e.g., battery capacity, age, type, discharge profile, etc.) for each hearing device 108, etc. Power consumption metric data 408 may include data representative of a power consumption metric for each hearing device 108.

Management facility 404 may perform any management operation associated with hearing devices 108. For example, management facility 404 may perform one or more communication operations, fitting operations, programming operations, etc. with respect to hearing devices 108.

Various operations that may be performed by fitting system 302 (e.g., management facility 404) will now be described. It will be recognized that fitting system 302 may perform additional or alternative operations to those described herein.

In some examples, fitting system 302 may detect a communicative coupling of binaural hearing system 102 to fitting system 302. For example, referring again to FIG. 3, fitting system 302 may detect a communicative coupling of binaural hearing system 102 to fitting system 302 by way of fitting communication link 304. Binaural hearing system 102 may be communicatively coupled to fitting system 302 in any suitable manner. For example, one or both of hearing devices 108 may be plugged in to fitting system 302 using a cable. As another example, one or both of hearing devices 108 may be wirelessly connected to fitting system 302 using any suitable wireless protocol.

Once binaural hearing system 102 is communicatively coupled to fitting system 302 by way of fitting communication link 304, a fitting session may commence. During the fitting session, fitting system 302 may perform various fitting operations with respect to hearing devices 108.

For example, in response to the fitting session commencing (or at any other point during the fitting session), fitting system 302 may determine power consumption metrics for both hearing devices 108. As mentioned, a power consumption metric for a hearing device indicates an amount of power (e.g., an absolute amount of power or an amount of power in terms of a percentage of the hearing device's total battery capacity) that the hearing device is expected to consume during a given time period while performing various operations (e.g., detecting and amplifying audio content, communicating with another hearing device by way of a binaural communication link, etc.).

A power consumption metric for hearing device 108-1 will often be different than a power consumption metric for hearing device 108-2. This difference in power consumption metrics may be due to one or more factors. For example, if a user has a higher degree of hearing loss in a first ear (e.g., the left ear) that is associated with hearing device 108-1 than in a second ear (e.g., the right ear) associated with hearing device 108-2, hearing device 108-1 may be required to provide a higher amount of sound amplification to the first ear than hearing device 108-2 is required to provide to the second ear. This higher amount of sound amplification requires additional power consumption by hearing device 108-1 compared to that required by hearing device 108-2, which may result in hearing device 108-1 having a higher power consumption metric than hearing device 108-2.

Fitting system 302 may determine a power consumption metric for each hearing device 108 in any suitable manner. For example, various manners in which fitting system 302 may determine a power consumption metric for hearing device 108-1 will now be described. It will be recognized that fitting system 302 may similarly determine a power consumption metric for hearing device 108-2 in any of the ways described herein. In some examples, the determination of the power consumption metrics may be based on information stored by fitting system 302, information provided by hearing devices 108, and/or information provided by an auxiliary device.

In some examples, fitting system 302 may determine a power consumption metric for hearing device 108-1 by accessing data representative of an operation program that hearing device 108-1 uses to deliver audio content to a user of binaural hearing system 102.

As mentioned, if hearing device 108-1 is a hearing aid, the operation program may specify an audio amplification scheme (e.g., amplification levels, etc.) used by hearing device 108-1 to deliver acoustic content to the user. As another example, if hearing device 108-1 is a sound processor included in a cochlear implant system, the operation program may specify a stimulation scheme used by hearing device 108-1 to direct a cochlear implant to apply electrical stimulation representative of acoustic content to the user. Because the operation program may include parameters that have been customized to a hearing ability of the particular ear with which hearing device 108-1 is associated, the operation program may indicate a relative power consumption demand that is required of hearing device 108-1 to deliver the audio content to the ear of the user.

Fitting system 302 may access the data representative of the operation program that hearing device 108-1 uses to deliver audio content to the user of binaural hearing system 102 in any suitable manner. For example, fitting system 302 may transmit data representative of a request for the operation program to hearing device 108-1 by way of fitting communication link 304. Hearing device 108-1 may receive the request, and, in response, retrieve data representative of the operation program from memory 114-1. Hearing device 108-1 may then transmit the requested data to fitting system 302 by way of fitting communication link 304.

Additionally or alternatively, fitting system 302 may access the data representative of the operation program by querying memory 402 of fitting system 302 for the data. For example, the data representative of the operation program may be maintained within memory 402 as part of hearing device data 406.

Upon receiving the requested data representative of the operation program, fitting system 302 may use the data to generate the power consumption metric for hearing device 108-1. This may be performed in any suitable manner.

Additionally or alternatively, fitting system 302 may determine a power consumption metric for hearing device 108-1 by accessing data representative of an audiogram associated with a first ear of the user (i.e., the ear that is associated with hearing device 108-1). The audiogram may provide information regarding a residual hearing ability of the first ear and/or one or more hearing thresholds of the first ear. For example, the audiogram may indicate the softest (e.g., lowest amplitude) sounds that the patient is able to hear at a variety of different frequencies.

Fitting system 302 may access the data representative of the audiogram in any suitable manner. For example, fitting system 302 may access the data representative of the audiogram querying memory 402 of fitting system 302 for the data. For example, the data representative of the audiogram may be maintained within memory 402 as part of hearing device data 406. Additionally or alternatively, fitting system 302 may access the data representative of the audiogram from any other source (e.g., the hearing device 108-1 or another computing device communicatively coupled to fitting system 302 by way of a network).

Upon accessing the data representative of the audiogram, fitting system 302 may use the data representative of the audiogram to generate the power consumption metric for hearing device 108-1. This may be performed in any suitable manner.

Additionally or alternatively, fitting system 302 may determine a power consumption metric for hearing device 108-1 by accessing data representative of a battery characteristic of battery 116-1. The battery characteristic may indicate a type, capacity, age, discharge profile, or any other property of battery 116-1.

Fitting system 302 may access the data representative of the battery characteristic in any suitable manner. For example, fitting system 302 may query memory 402 and/or memory 114-1 for the data. Additionally or alternatively, fitting system 302 may perform one or more diagnostic tests on battery 116-1 to determine the battery characteristic.

Upon accessing the data representative of the battery characteristic, fitting system 302 may use the data representative of the battery characteristic to generate the power consumption metric for hearing device 108-1. This may be performed in any suitable manner.

Once fitting system 302 determines a first power consumption metric for hearing device 108-1 and a second power consumption metric for hearing device 108-2, system 302 may compare the first and second power consumption metrics to determine which is lower. If fitting system 302 determines that the first power consumption metric is lower than the second power consumption metric, system 302 may assign a first operating role to hearing device 108-1 and a second operating role to hearing device 108-2. Alternatively, if fitting system 302 determines that the second power consumption metric is lower than the first power consumption metric, system 302 may assign the first operating role to hearing device 108-2 and the second operating role to hearing device 108-1.

In the examples provided herein, it will be assumed that fitting system 302 determines that the first power consumption metric is lower than the second power consumption metric. Hence, in the examples provided herein, fitting system 302 assigns a first operating role to hearing device 108-1 and a second operating role to hearing device 108-2.

The first operating role assigned to hearing device 108-1 specifies that hearing device 108-1 is to be wirelessly connected with external device 104 during a communication session subsequent to the fitting session. In contrast, the second operating role assigned to hearing device 108-2 specifies that the hearing device 108-2 is to remain wirelessly unconnected with external device 104 during the communication session. The first operating role assigned to hearing device 108-1 may further specify that hearing device 108-1 is to enable hearing device 108-2 to receive the audio content without being connected with external device 104. For example, the first operating role may specify that hearing device 108-1 is to relay data received from external device 104 to hearing device 108-2 by way of binaural communication link 110. Alternatively, the first operating role may specify that hearing device 108-1 is to provide information to hearing device 108-2 by way of binaural communication link 110 that allows hearing device 108-2 to receive the data while operating in the eavesdropping mode.

Fitting system 302 may assign the first operating role to hearing device 108-1 and the second operating role to hearing device 108-2 in any suitable manner. For example, fitting system 302 may maintain data representative of the role assignments and, as will be described blow, present the role assignments in a graphical user interface to a user of fitting system 302. As will be described below, assignment of the pairing and second operating role may not actually program hearing devices 108 with the roles until the assignments are approved by a user of fitting system 302. Alternatively, assignment of the pairing and second operating roles may automatically program hearing devices 108 with the roles.

In some examples, fitting system 302 may be configured to present a graphical user interface to a user. The graphical user interface may be displayed by a display device (e.g., a computer monitor) included in or connected to fitting system 302, and may facilitate user interaction with fitting system 302.

Figure 5:
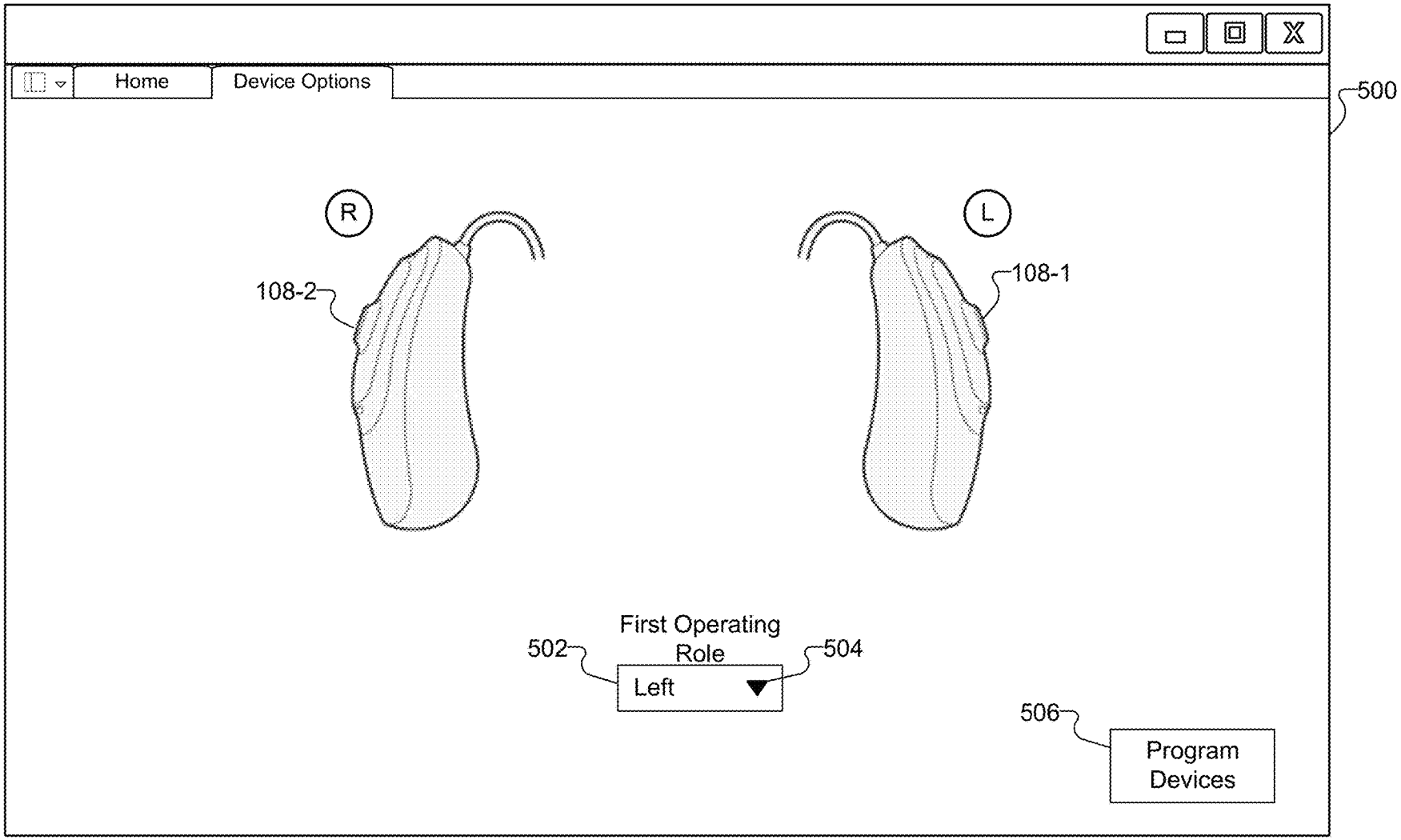
FIG. 5 shows an exemplary graphical user interface according to principles described herein.

In some examples, fitting system 302 may present, within the graphical user interface, information indicating that the first operating role is assigned to the first hearing device 108-1. To illustrate, FIG. 5 shows an exemplary graphical user interface 500 that may be presented by fitting system 302. As shown, graphical user interface 500 may display graphical depictions of hearing devices 108. Additional information, such as ear associations for each hearing device 108, may also be displayed in graphical user interface 500. As shown, field 502 includes information indicating that the first operating role is assigned to hearing device 108-1 (which, in this example, corresponds to the left ear).

In some examples, fitting system 302 may allow a user to override the role assignments assigned to hearing devices 108. For example, as shown, an override option 504 (which, in this example, is a drop-down menu option) is provided within graphical user interface 500. In response to a user selection of override option 504, fitting system 302 may switch the role assignments for hearing devices 108. To illustrate, in response to a user selection of override option 504, fitting system 302 may assign the first operating role to hearing device 108-2 (which, in this example, corresponds to the right ear) and the second operating role to hearing device 108-1.

As shown, a "program devices" option 506 is displayed in graphical user interface 500. In response to a user selection of option 506, fitting system 302 may program hearing devices 108 with their assigned roles. In alternative examples, system 302 may program hearing devices 108 with their assigned roles without receiving user input specifically directing fitting system 302 to program hearing devices 108 with their assigned roles.

Figure 6:
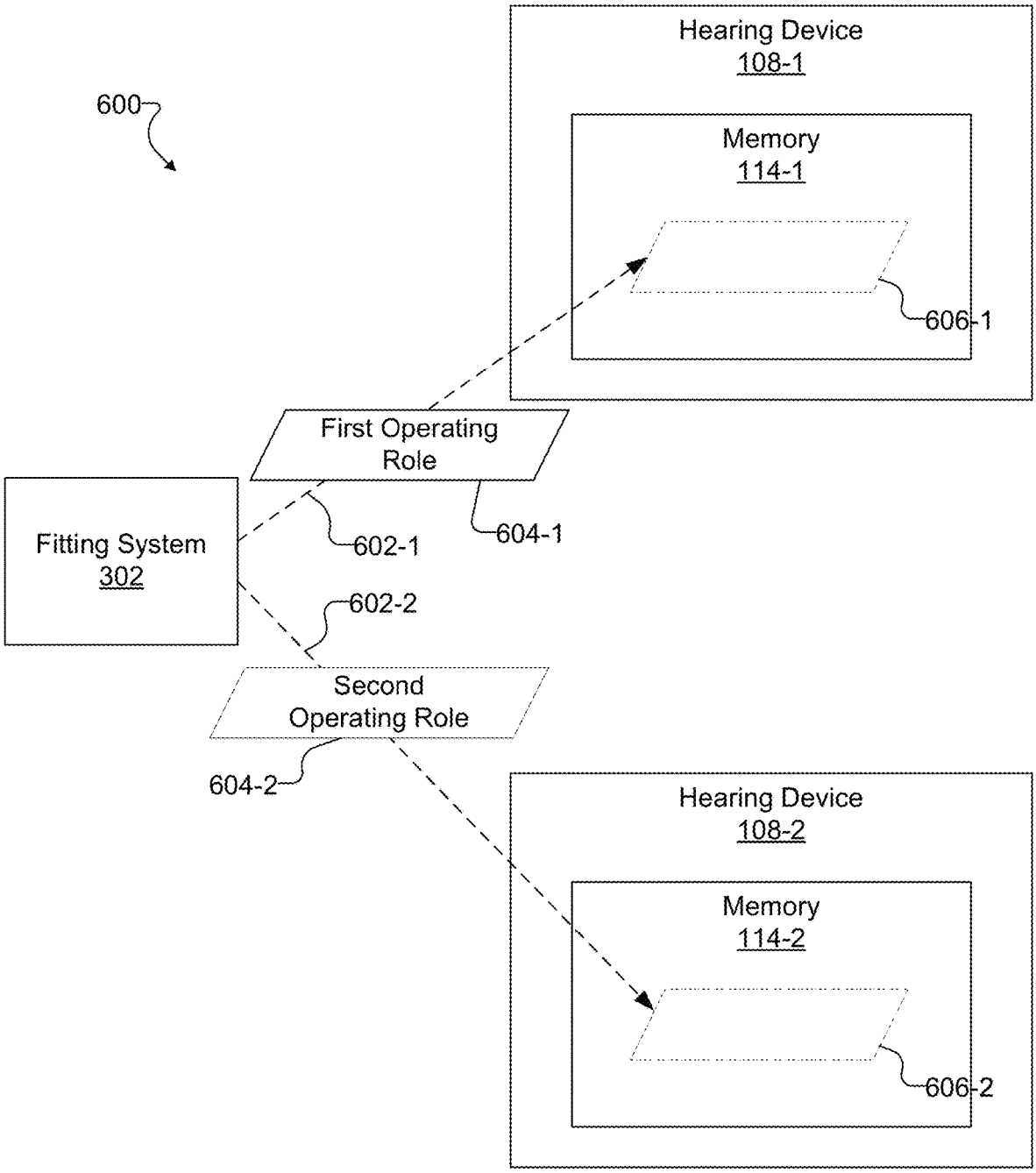
FIG. 6 shows an exemplary programming operation according to principles described herein.

Fitting system 302 may program hearing devices 108 to operate in accordance with their assigned roles in any suitable manner. For example, FIG. 6 shows an exemplary programming operation 600 that may be performed by fitting system 302 to program hearing devices 108 to operate in accordance with their assigned roles. As indicated by arrow 602-1, fitting system 302 may program hearing device 108-1 to operate in accordance with the first operating role by writing data 604-1 representative of the first operating role to a slot 606-1 within memory 114-1 of hearing device 108-1. Likewise, as indicated by arrow 602-2, fitting system 302 may program hearing device 108-2 to operate in accordance with the second operating role by writing data 604-2 representative of the second operating role to a slot 606-2 within memory 114-2 of hearing device 108-2.

Once hearing devices 108 are programmed to operate in accordance with their respective roles, hearing devices 108 may communicate with external device 104. For example, as described in connection with FIG. 6, hearing device 108-1 may maintain, within memory 114-1, data representative of a first operating role and hearing device 108-2 may maintain, within memory 114-2, data representative of a second operating role. In this configuration, processor 112-1 of hearing device 108-1 may establish, in accordance with the first operating role, wireless communication link 106 with external device 104. Processor 112-2 of hearing device 108-2 may abstain from establishing a wireless communication link with external device 104 in accordance with the second operating role. Processor 112-1 may receive, by way of wireless communication link 106, audio content output by external device 104. Processor 112-1 may process the audio content and relay the audio content to processor 112-2 of hearing device 108-2 by way of binaural communication link 110. In this manner, processors 112-1 and 112-2 may both provide the audio content to the user. Alternatively, processor 112-1 may provide information to processor 112-2 that enables processor 112-2 to operate in an eavesdropping mode.

Figure 7:
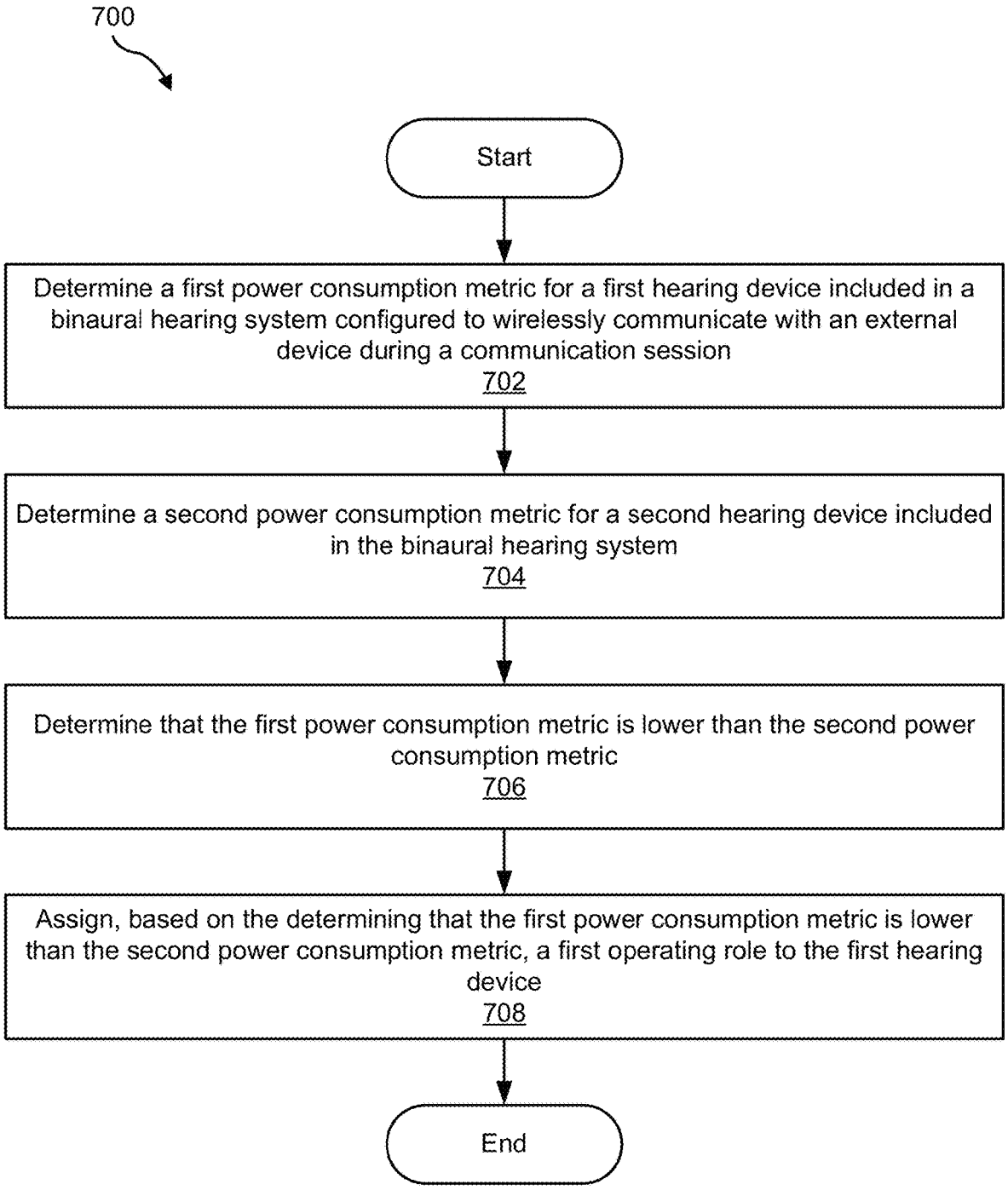
FIG. 7 illustrates an exemplary method for optimizing battery usage for binaural hearing systems according to principles described herein.

FIG. 7 illustrates an exemplary method 700 for optimizing battery usage for binaural hearing systems. One or more of the operations shown in FIG. 7 may be performed by fitting system 302 and/or any implementation thereof. While FIG. 7 illustrates exemplary operations according to one embodiment, other embodiments may omit, add to, reorder, and/or modify any of the operations shown in FIG. 7.

In operation 702, a fitting system determines a first power consumption metric for a first hearing device included in a binaural hearing system configured to wirelessly communicate with an external device during a communication session. Operation 702 may be performed in any of the ways described herein.

In operation 704, the fitting system determines a second power consumption metric for a second hearing device included in the binaural hearing system. Operation 704 may be performed in any of the ways described herein.

In operation 706, the fitting system determines that the first power consumption metric is lower than the second power consumption metric. Operation 706 may be performed in any of the ways described herein.

In operation 708, the fitting system assigns, based on the determining that the first power consumption metric is lower than the second power consumption metric, a first operating role to the first hearing device. Operation 708 may be performed in any of the ways described herein.

In the preceding description, various exemplary embodiments have been described with reference to the accompanying drawings. It will, however, be evident that various modifications and changes may be made thereto, and additional embodiments may be implemented, without departing from the scope of the invention as set forth in the claims that follow. For example, certain features of one embodiment described herein may be combined with or substituted for features of another embodiment described herein. The description and drawings are accordingly to be regarded in an illustrative rather than a restrictive sense.

What is claimed is:

1. A fitting system for fitting a binaural hearing system comprising:

a computing device configured to determine a first power consumption metric for a first hearing device included in the binaural hearing system configured to wirelessly communicate with an external device during a communication session;

determine a second power consumption metric for a second hearing device included in the binaural hearing system;

determine that the first power consumption metric is lower than the second power consumption metric;

assign, by the fitting system based on the determination that the first power consumption metric is lower than the second power consumption metric, a first operating role to the first hearing device, the first operating role specifying that the first hearing device is to be wirelessly connected with the external device during the communication session; and present, within a graphical user interface, information indicating that the first operating role is assigned to the first hearing device.

2. The fitting system of claim 1, wherein the computing device is further configured to assign, based on the determination that the first power consumption metric is lower than the second power consumption metric, a second operating role to the second hearing device, the second operating role specifying that the second hearing device is to remain unconnected with the external device during the communication session.

3. The fitting system of claim 1, wherein the computing device is configured to determine the first power consumption metric for the first hearing device by accessing data representative of an operation program that the first hearing device uses to deliver audio content to a user of the binaural hearing system; and generating, based on the data representative of the operation program, the first power consumption metric for the first hearing device.

4. The fitting system of claim 3, wherein the first hearing device is a hearing aid and the operation program specifies an audio amplification scheme used by the first hearing device.

5. The fitting system of claim 3, wherein the first hearing device is a sound processor included in a cochlear implant system and the operation program specifies a stimulation scheme used by the cochlear implant system.

6. The fitting system of claim 3, wherein the computing device is configured to access the data representative of the operation program by:

transmitting data representative of a request for the operation program to the first hearing device by way of a fitting communication link between the fitting system and the binaural hearing system; and receiving, in response to the request and by way of the fitting communication link, data identifying the operation program.

7. The fitting system of claim 1, wherein the computing device is configured to determine the first power consumption metric for the first hearing device by accessing data representative of an audiogram associated with a first ear of a user of the binaural hearing system; and generating, based on the data representative of the audiogram, the first power consumption metric for the first hearing device.

8. The fitting system of claim 1, wherein the computing device is configured to determine the first power consumption metric for the first hearing device by accessing data representative of a battery characteristic of a battery used by the first hearing device; and generating, based on the data representative of the battery characteristic, the first power consumption metric for the first hearing device.

9. The fitting system of claim 1, wherein the computing device is further configured to provide, within the graphical user interface, an option for a user to override the assignment of the first operating role to the first hearing device and instead assign the first operating role to the second hearing device.

10. The fitting system of claim 9, wherein the computing device is further configured to:

detect a selection by the user of the option to override the assignment of the first operating role to the first hearing device; and in response to the selection of the option assign the first operating role to the second hearing device, the first operating role now specifying that the second hearing device is to be wirelessly connected with the external device during the communication session, and assign a second operating role to the first hearing device, the second operating role specifying that the first hearing device is to remain wirelessly unconnected with the external device during the communication session.

11. The fitting system of claim 1, wherein the computing device is further configured to program the first hearing device to operate in accordance with the first operating role.

12. The fitting system of claim 11, wherein the computing device is configured to program the first hearing device to operate in accordance with the first operating role by writing data representative of the pairing mode to memory of the first hearing device.

13. A method comprising:

determining a first power consumption metric for a first hearing device included in a binaural hearing system configured to wirelessly communicate with an external device during a communication session;

determining a second power consumption metric for a second hearing device included in the binaural hearing system;

determining that the first power consumption metric is lower than the second power consumption metric;

assigning, based on the determining that the first power consumption metric is lower than the second power consumption metric, a first operating role to the first hearing device, the first operating role specifying that the first hearing device is to be wirelessly connected with the external device during the communication session; and presenting, within a graphical user interface, information indicating that the first operating role is assigned to the first hearing device.

14. The method of claim 13, further comprising assigning, based on the determining that the first power consumption metric is lower than the second power consumption metric, a second operating role to the second hearing device, the second operating role specifying that the second hearing device is to remain wirelessly unconnected with the external device during the communication session.

15. The method of claim 13, wherein the determining of the first power consumption metric for the first hearing device comprises:

accessing data representative of an operation program that the first hearing device uses to deliver audio content to a user of the binaural hearing system; and generating, based on the data representative of the operation program, the first power consumption metric for the first hearing device.

16. The method of claim 13, wherein the determining of the first power consumption metric for the first hearing device comprises:

accessing data representative of an audiogram associated with a first ear of a user of the binaural hearing system; and generating, based on the data representative of the audiogram, the first power consumption metric for the first hearing device.

17. The method of claim 13, wherein the determining of the first power consumption metric for the first hearing device comprises:

accessing data representative of a battery characteristic of a battery used by the first hearing device; and generating, based on the data representative of the battery characteristic, the first power consumption metric for the first hearing device.

18. A fitting system for fitting a binaural hearing system comprising:

a computing device configured to transmit data representative of a request for an operation program to a first hearing device included in the binaural hearing system by way of a fitting communication link, the operation program used by the first hearing device to deliver audio content to a user of the binaural hearing system;

receive, in response to the request and by way of the fitting communication link, data identifying the operation program;

generate, based on the data identifying of the operation program, a first power consumption metric for the first hearing device;

determine a second power consumption metric for a second hearing device included in the binaural hearing system;

determine that the first power consumption metric is lower than the second power consumption metric; and assign, by the fitting system based on the determination that the first power consumption metric is lower than the second power consumption metric, a first operating role to the first hearing device, the first operating role specifying that the first hearing device is to be wirelessly connected with an external device during a communication session.

19. The fitting system of claim 18, wherein the computing device is further configured to present, within a graphical user interface, information indicating that the first operating role is assigned to the first hearing device.

* * * * *